US011125059B2

(12) United States Patent
Biddick et al.

(10) Patent No.: US 11,125,059 B2
(45) Date of Patent: Sep. 21, 2021

(54) DOWNHOLE-TYPE TOOL FOR ARTIFICIAL LIFT

(71) Applicant: Upwing Energy, LLC, Cerritos, CA (US)

(72) Inventors: David Biddick, Houston, TX (US); Kuo-Chiang Chen, Kennedale, TX (US); Patrick McMullen, Villa Park, CA (US)

(73) Assignee: Upwing Energy, LLC, Cerritos, CA (US)

( * ) Notice: Subject to any disclaimer, the term of this patent is extended or adjusted under 35 U.S.C. 154(b) by 50 days.

(21) Appl. No.: 16/239,221

(22) Filed: Jan. 3, 2019

(65) Prior Publication Data

US 2020/0217183 A1 Jul. 9, 2020

(51) Int. Cl.
*E21B 43/12* (2006.01)
*E21B 33/14* (2006.01)

(52) U.S. Cl.
CPC ..... *E21B 43/128* (2013.01); *E21B 33/14* (2013.01)

(58) Field of Classification Search
CPC ..... E21B 43/12; E21B 43/128; E21B 33/14
See application file for complete search history.

(56) References Cited

U.S. PATENT DOCUMENTS 5,620,048 A * 4/1997 Beauquin ..... F04B 47/06 166/62
6,167,965 B1 * 1/2001 Bearden ..... E21B 43/385 166/250.15
6,557,642 B2 5/2003 Head
2001/0050173 A1 * 12/2001 Head ..... E21B 17/028 166/381
2009/0272129 A1 * 11/2009 Petty ..... H02K 5/132 62/64
2011/0079391 A1 * 4/2011 Bedouet ..... E21B 47/017 166/302
2014/0221531 A1 * 8/2014 Iyer ..... C09D 183/06 523/456
2016/0123123 A1 5/2016 MacLean et al.
2017/0264158 A1 * 9/2017 Li ..... F04B 17/03
2017/0292533 A1 * 10/2017 Zia ..... E21B 43/128
2018/0335323 A1 * 11/2018 Lu ..... E21B 33/0385

* cited by examiner

*Primary Examiner* — Crystal J Miller
(74) *Attorney, Agent, or Firm* — Fish & Richardson P.C.

(57) ABSTRACT

A downhole-type tool includes a casing joint, a housing affixed to the casing joint, and an electric stator encased in the housing. The housing defines an inner bore and has an inner bore wall that is continuous with an inner wall of the casing joint. The housing is sealed against ingress of cement to the stator. The electric stator is configured to drive an electric rotor-impeller. A flow of cement can be received with an outer surface of the housing. The flow of cement can be directed into an annulus between the housing and a wall of a wellbore. The casing joint can be cemented in the wellbore.

11 Claims, 12 Drawing Sheets

DOWNHOLE-TYPE TOOL FOR ARTIFICIAL LIFT

TECHNICAL FIELD

This disclosure relates to downhole-type tools for artificial lift, and more specifically, downhole-type electric motors for artificial lift.

BACKGROUND

Artificial lift equipment, such as electric submersible pumps, compressors, and blowers, can be used in downhole applications to increase fluid flow within a well, thereby extending the life of the well. Such equipment, however, can fail due to a number of factors. Equipment failure can sometimes require workover procedures, which can be costly. On top of this, workover procedures can include shutting in a well in order to perform maintenance on equipment, resulting in lost production. Lost production negatively affects revenue and is therefore typically avoided when possible.

SUMMARY

Certain aspects of the subject matter described can be implemented as a method. A flow of cement is received with an outer surface of a housing. The flow of cement is directed into an annulus between the housing and a wall of a wellbore. The housing encases an electric stator and is sealed against ingress of cement to the electric stator.

This, and other aspects, can include one or more of the following features. Receiving the flow of cement with the outer surface of the housing can include receiving the flow of cement with a top wall, a bottom wall, and an outer, circumferential wall of the housing. Receiving the flow of cement with the outer surface of the housing can include receiving the flow of cement through a flow path defined in the housing. The flow path can extend between the top wall and the bottom wall of the housing. The flow path can extend between the outer, circumferential wall and the bottom wall of the housing. The housing can define an inner bore and have an inner, circumferential wall that is continuous with an inner wall of a casing joint affixed to the housing. A flow of well fluid can be received at the inner, circumferential wall of the housing. With the electric stator, power can be received from a remote location. With the electric stator, an electric rotor-impeller positioned within the inner bore of the housing can be driven in response to receiving power.

Certain aspects of the subject matter described can be implemented as a method. Cement is flowed into a wellbore around an electric stator affixed to a casing joint at a location in the wellbore. The electric stator is encased within a housing sealed against ingress of cement to the electric stator. The electric stator is configured to drive an electric rotor-impeller. The housing defines an inner bore and has an inner bore wall that is continuous with an inner wall of the casing joint. The casing joint is cemented at the location in the wellbore.

This, and other aspects, can include one or more of the following features. A cable connecting the stator to a power source at a remote location can be cemented in the wellbore and outside the casing joint. The wellbore can be enlarged at the location within which the electric stator will reside in the wellbore. After enlarging the wellbore and before flowing cement into the wellbore, the electric stator affixed to the casing joint can be positioned within the location at which the wellbore was enlarged. Flowing cement into the wellbore can include flowing cement into an annulus between the housing and a wall of the wellbore. Flowing cement into the wellbore can include flowing cement through a flow path defined in the housing. After cementing the casing joint, the electric-rotor impeller can be positioned within the inner bore of the housing. The electric rotor-impeller can be retrieved from the wellbore while the electric stator remains within the housing.

Certain aspects of the subject matter described can be implemented as a downhole-type tool. The downhole-type tool includes a casing joint, a housing affixed to the casing joint, and an electric stator encased in the housing. The housing defines an inner bore and has an inner bore wall that is continuous with an inner wall of the casing joint. The housing is sealed against ingress of cement to the electric stator. The electric stator is configured to drive an electric rotor-impeller.

This, and other aspects, can include one or more of the following features. The downhole-type tool can include the electric rotor-impeller. The electric rotor-impeller can be configured to be retrievable from a wellbore while the electric stator remains within the wellbore. The housing can include a cooling port for connecting to a cooling tube providing a coolant from a remote location to the housing. The housing can define a flow path for flow of cement. The downhole-type tool can include a cable connected to the stator for providing power from a remote location to the stator to drive the electric rotor-impeller. The cable can be configured to be cemented in the wellbore outside of the casing joint.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes downhole-type tools for artificial lift. Artificial lift systems installed downhole are often exposed to hostile downhole environments. Artificial lift system failures are often related to failures in the electrical system supporting the artificial lift system. In order to avoid costly workover procedures, it can be beneficial to isolate electrical portions of such artificial lift systems to portions of a well that exhibit less hostile downhole environments in comparison to the producing portions of the well. In some implementations, the electrical components of the artificial lift system are separated from rotating portions of the artificial lift system.

The subject matter described in this disclosure can be implemented in particular implementations, so as to realize one or more of the following advantages. Use of artificial lift systems described in this disclosure can increase production from wells. In some implementations, separating the electrical components of the artificial lift system from its rotating portions can improve reliability in comparison to artificial lift systems where electrical systems and electrical components are integrated with both non-rotating and rotating portions. The artificial lift systems described herein can be more reliable than artificial lift systems with electrical components integrated with both non-rotating and rotating portions, resulting in lower total capital costs over the life of a well. The improved reliability can also reduce the frequency of workover procedures, thereby reducing periods of lost production and maintenance costs. The downhole-type tool described here can include an electric stator that defines an inner bore and has an inner bore wall that is continuous with an inner bore of a casing of a well, such that one or more rotatable portions of the tool (such as its impellers) can occupy a larger space to provide more lift in comparison to comparable downhole-type tools that are more restricted in space (for example, electric submersible pumps that reside within a production tubing of a well or electric submersible pumps, in which the impellers are restricted in size by the production tubing of the well).

Figure 1:
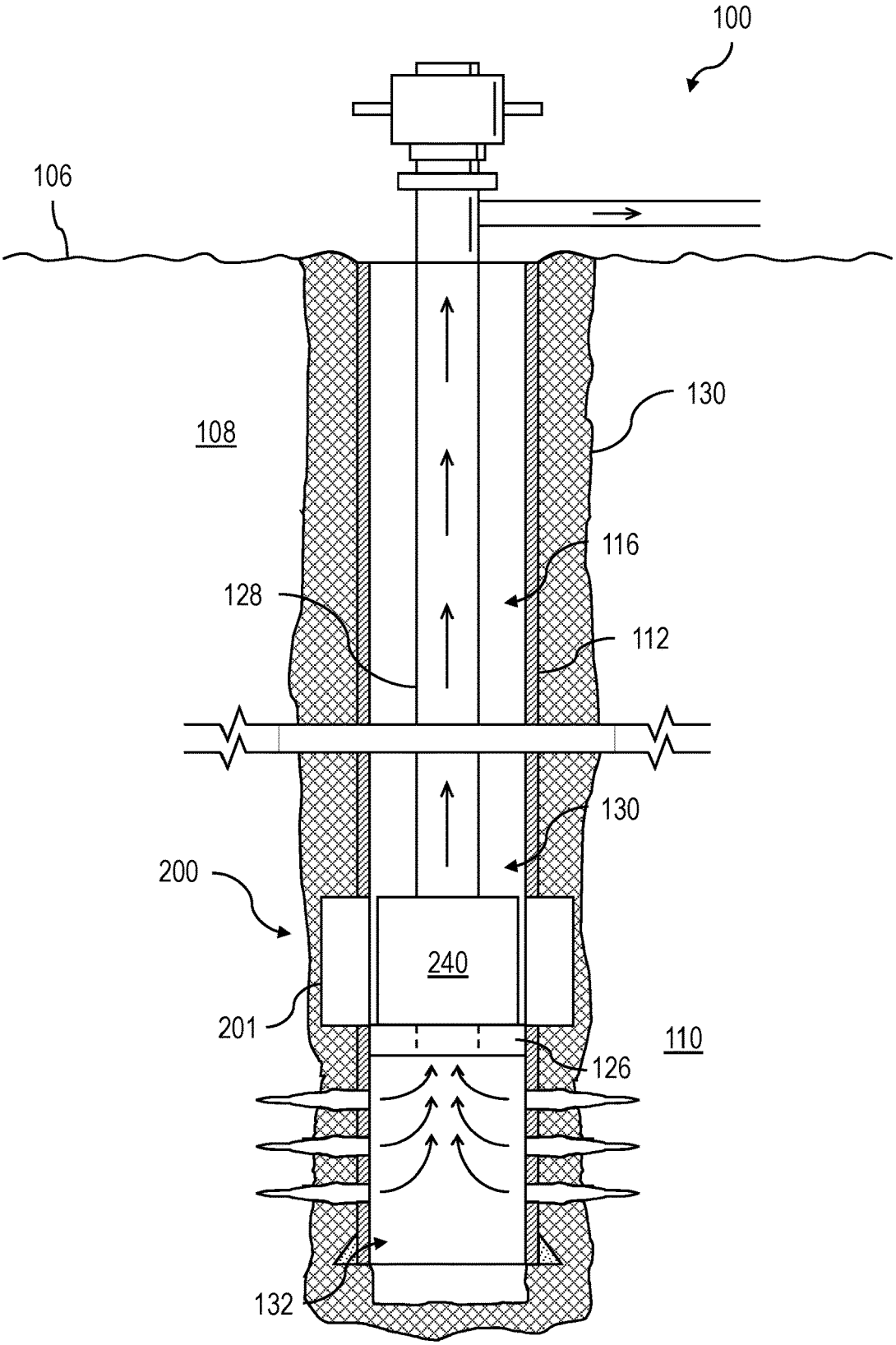
FIG. 1 is a schematic diagram of an example well.

FIG. 1 depicts an example well 100 constructed in accordance with the concepts herein. The well 100 includes a wellbore that extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, whereas in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well,": the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells, it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. The casing 112 can be cemented in the wellbore, for example, by flowing cement into the annulus between the casing 112 and the wellbore wall 130. In some implementations, cement can be flowed through the inner bore of the casing 112 and directed to the outside of the casing and back up to the surface 106. In such implementations, the inner bore of the casing 112 can subsequently be cleaned of cement, while the outside of the casing 112 is cemented in place within the well 100. In some implementations, cement can be flowed through the inner bore of a tubing positioned within the casing 112. In such implementations, a seal can be used to seal a downhole end of the tubing to the casing 112, such that the annulus between the tubing and the casing 112 is isolated from the flow of cement. The cement can then be directed to the outside of the casing and back up to the surface 106. The inner bore of the tubing can subsequently be cleaned of cement, while the outside of the casing 112 is cemented in place within the well 100. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 can also include a downhole-type tool 200 residing in the wellbore, for example, at a depth that is nearer to subterranean zone 110 than the surface 106. The downhole-type tool 200, being of a type configured in size and of robust construction for installation within a well 100, can include any type of pump, compressor, or blower that can assist production of fluids to the surface 106 and out of the well 100 by creating an additional pressure differential within the well 100. Also, notably, while the concepts herein are discussed with respect to an electric submersible pump (ESP), they are likewise applicable to other types of pumps, compressors, blowers and devices for moving multi-phase fluid.

In particular, casing 112 can be commercially produced in a number of common sizes specified by the American Petroleum Institute (the "API), including 4-½, 5, 5-½, 6, 6-⅝, 7, 7-⅝, 16/8, 9-⅝, 10-¾, 11-¾, 13-⅜, 16, 116/8 and 20 inches, and the API specifies internal diameters for each casing size. The casing 112 can be made of a single material or a composite material. In some implementations, the casing 112 can include a non-metallic portion. One or more portions of the downhole-type tool 200 can be configured to fit in, and (as discussed in more detail below) in certain instances, seal to the inner diameter of one of the specified API casing sizes. Of course, one or more portions of the downhole-type tool 200 can be made to fit in and, in certain instances, seal to other sizes of casing or tubing or otherwise seal to a wall of the well 100. As shown in FIG. 1, one or more portions of the downhole-type tool 200 can be attached to a production tubing 128 in the well 100, and one or more portions of the downhole-type tool 200 can be attached to the casing 112. Portions of the downhole-type tool 200 do not need to reside within the tubing 128 and can have dimensions that are larger than the inner diameter of the tubing 128. The largest outer diameter of the downhole-type tool 200 may therefore be larger than the inner diameter of the tubing 128. Similarly, portions of the downhole-type tool 200 do not need to reside within the casing 112 and can have dimensions that are larger than the inner diameter of the casing 112. The largest outer diameter of the downhole-type tool 200 may therefore be larger than the inner diameter of the casing 112.

Additionally, the construction of the components of the downhole-type tool 200 are configured to withstand the impacts, scraping, and other physical challenges the downhole-type tool 200 will encounter while being passed hundreds of feet/meters or even multiple miles/kilometers into and out of the well 100. For example, the downhole-type tool 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the downhole-type tool 200 is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the downhole-type tool 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

A seal system 126 integrated or provided separately with a downhole system, as shown with the downhole-type tool 200, and divides the well 100 into an uphole zone 130 above the seal system 126 and a downhole zone 132 below the seal system 126. Although shown in FIG. 1 as being located downhole of the downhole-type tool 200, the seal system 126 can optionally be located uphole of the downhole-type tool 200. In some implementations, at least a portion of the seal system 126 can reside within the downhole-type tool 200. FIG. 1 shows a portion of the downhole-type tool 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112. The well 100 can include open hole wellbore wall in uncased portions of the well 100. The seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the downhole-type tool 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, the seal system 126 includes a production packer. Although not shown in FIG. 1, additional components, such as a surface pump, can be used in conjunction with the downhole-type tool 200 to boost pressure in the well 100. In some implementations, the seal system 126 is not required.

In some implementations, the downhole-type tool 200 can be implemented to alter characteristics of a wellbore by a mechanical intervention at the source. Alternatively, or in addition to any of the other implementations described in this specification, the downhole-type tool 200 can be implemented in a direct well-casing deployment for production through the wellbore. Other implementations of the downhole-type tool 200 can be utilized in conjunction with additional pumps, compressors, or multiphase combinations of these in the well bore to effect increased well production.

The downhole-type tool 200 locally alters the pressure, temperature, and/or flow rate conditions of the fluid in the well 100 proximate the downhole-type tool 200. In certain instances, the alteration performed by the downhole-type tool 200 can optimize or help in optimizing fluid flow through the well 100. As described previously, the downhole-type tool 200 creates a pressure differential within the well 100, for example, particularly within the locale in which the downhole-type tool 200 resides. In some instances, a pressure at the base of the well 100 is a low pressure (for example, sub-atmospheric); so, unassisted fluid flow in the wellbore can be slow or stagnant. In these and other instances, the downhole-type tool 200 introduced to the well 100 adjacent the perforations can reduce the pressure in the well 100 near the perforations to induce greater fluid flow from the subterranean zone 110, increase a temperature of the fluid entering the downhole-type tool 200 to reduce condensation from limiting production, and/or increase a pressure in the well 100 uphole of the downhole-type tool 200 to increase fluid flow to the surface 106.

The downhole-type tool 200 moves the fluid at a first pressure downhole of the downhole-type tool 200 to a second, higher pressure uphole of the downhole-type tool 200. The downhole-type tool 200 can operate at and maintain a pressure ratio across the downhole-type tool 200 between the second, higher uphole pressure and the first, downhole pressure in the wellbore. The pressure ratio of the second pressure to the first pressure can also vary, for example, based on an operating speed of the downhole-type tool 200. The downhole-type tool 200 can operate at a variety of speeds, for example, where operating at higher speeds increases fluid flow, and operating at lower speeds reduces fluid flow. In some implementations, the downhole-type tool 200 can operate at speeds up to 120,000 revolutions per minute (rpm). In some implementations, the downhole-type tool 200 can operate at lower speeds (for example, 8,000 rpm). Specific operating speeds for the downhole-type tool 200 can be defined based on the fluid (in relation to its composition and physical properties) and flow conditions (for example, pressure, temperature, and flow rate) for the well parameters and desired performance. Speeds can be, for example, as low as 4,000 rpm or as high as 120,000 rpm. While the downhole-type tool 200 can be designed for an optimal speed range at which the downhole-type tool 200 performs most efficiently, this does not prevent the downhole-type tool 200 from running at less efficient speeds to achieve a desired flow for a particular well, as well characteristics change over time.

The downhole-type tool 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The downhole-type tool 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The downhole-type tool 200 can operate in above atmospheric well pressures, for example, at well pressure between 14.7 psia (101.3 kPa) and 5,000 psia (34,474 kPa).

Figure 2A:
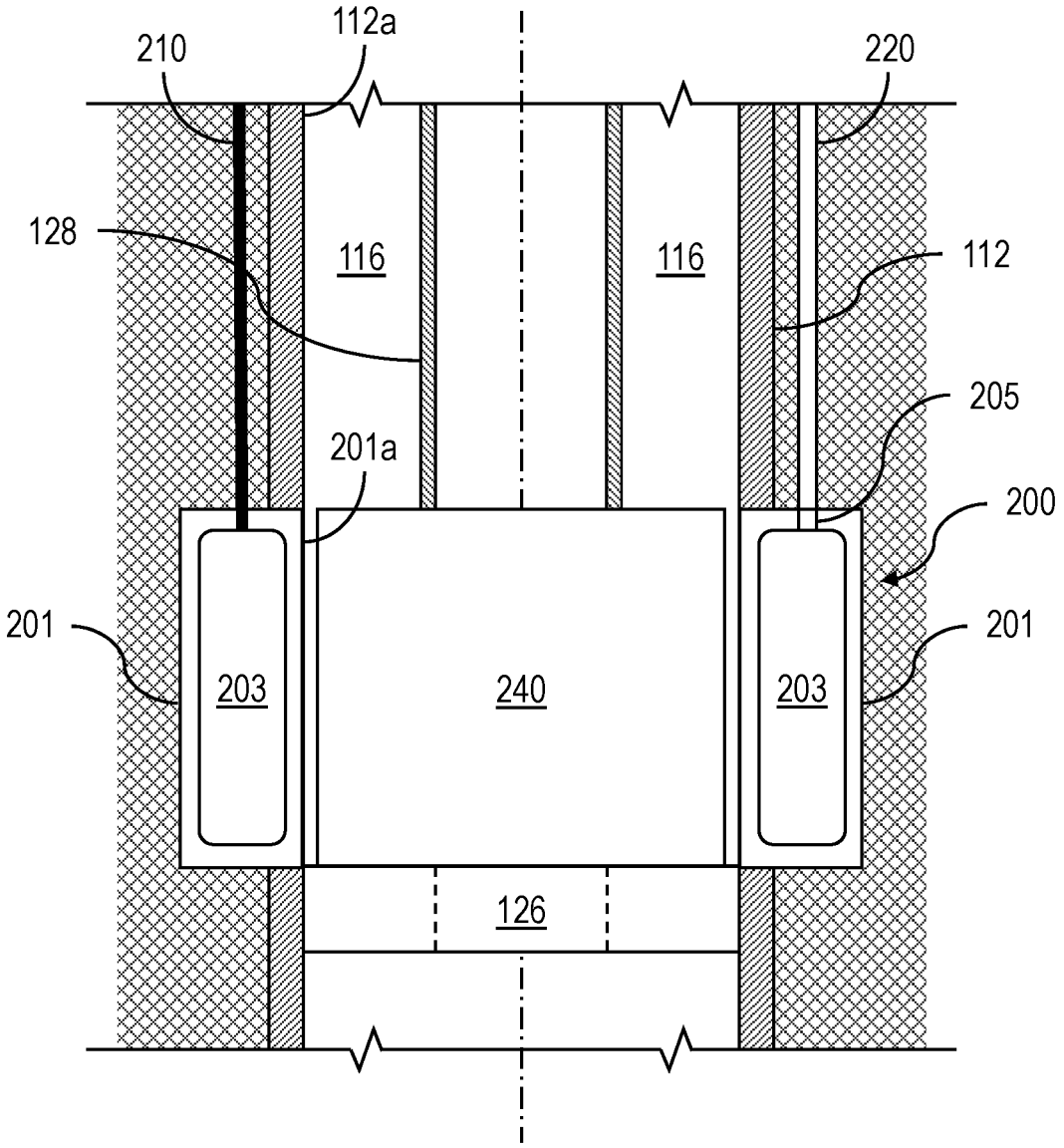
FIGS. 2A, 2B, 3 and 4 are schematic diagrams of example downhole-type tools.

Referring to FIG. 2A, the downhole-type tool 200 includes a casing joint (such as a portion of the casing 112), a housing 201 affixed to the casing joint 112, and an electric stator 203 encased in the housing 201. The housing 201 can be affixed to the casing joint 112, for example, by welding, casting, or threading them together. The connection between the housing 201 and the casing joint 112 should be able to withstand tensile and compression loads (for example, from the weight of the casing joint 112 below the housing 201). The housing 201 defines an inner bore and has an inner bore wall 201*a* that is continuous with an inner wall 112*a* of the casing joint 112. The casing joint 112 and the housing 201 therefore define a continuous inner bore for the flow of well fluid. The housing 201 has mechanical strength and structural integrity that are at least equal to those of the casing joint 112. For example, the housing 201 is able to take certain torsional loads of the casing 112. For example, the housing 201 is configured to withstand the operating conditions of the downhole environment and provide a hydraulic barrier between the inner bore and the wellbore (similar to the casing 112). The housing 201 is sealed against ingress of cement to the electric stator 203. The electric stator 203 is configured to drive an electric rotor-impeller 240. In some implementations, the downhole-type tool 200 includes the electric rotor-impeller 240.

The downhole-type tool 200 can include a cable 210 connecting the stator 203 to a power source at a remote location (for example, the surface 106). At least a portion of the cable 210 can be configured to be cemented in the well 100, for example, outside of the casing 112. That portion of the cable 210 can be ruggedized and sealed against ingress of fluid and/or cement. For example, at least a portion of the cable 210 can be covered by a tubing, coating, or another type of protective layer that can prevent direct exposure of the cable 210 to an outer environment (such as the downhole environment). The protective layer can be metallic or non-metallic, as long as the protective layer is chemically compatible with the expected downhole/wellbore fluids and thermally stable in the downhole environment. For example, the cable 210 can be one or more wires that are embedded in a metal tube or contained within a metal jacket that isolates the cable 210 from cement. The cable 210 can be connected to and transmit power to multiple electrical components within the housing 201.

In some implementations, the downhole-type tool 200 can include a cooling port 205 for connecting to a cooling tube 220. The cooling port 205 can be sealed against ingress of cement into the housing 201. The cooling tube 220 can connect the housing 201 to a coolant source at a remote location (for example, the surface 106). At least a portion of the cooling tube 220 can be configured to be cemented in the well 100, for example, outside of the casing 112. That portion of the cooling tube 220 can be ruggedized and sealed against ingress of fluid and/or cement. The coolant can be provided from the coolant source and be circulated through the housing 201 to provide cooling to the stator 203. The circulating coolant can remove heat from various components (or a heat sink) within the housing 201. Similar to the cable 210, the cooling tube 220 can be ruggedized and sealed against ingress of cement. In some implementations, the coolant floods the inner volume of the housing 201 within which the stator 203 resides. In some implementations, the coolant circulates within portions of the housing 201 where heat dissipation to the well fluid (for example flowing past the inner bore of the housing 201) is limited. The coolant circulating through the housing 201 can lower the operating temperature of the housing 201 (which can help to extend the operating life of the downhole-type tool 200), particularly when the surrounding temperature of the environment would otherwise prevent the downhole-type tool 200 from meeting its intended operating life.

In some implementations, the housing 201 includes a jacket through which the coolant can circulate to remove heat from the stator 203 and/or other components within the housing 201. In some implementations, the jacket is in the form of tubing or a coil positioned within the housing 201 through which the coolant can circulate to remove heat from the stator 203 and/or other components within the housing 201. In some implementations, the coolant can be isolated within the jacket and not directly interact with other components within the housing 201. In such implementations, the housing 201 is not flooded by the coolant. In some implementations, coolant does not circulate through the housing 201 (that is, coolant is not continuously supplied from the coolant source to the housing 201). Instead, one or more portions of the housing 201 are simply flooded with coolant without coolant flowing into or out of the housing 201 during operation of the downhole-type tool 200. In some implementations, the coolant may not be necessary, as heat from the electric motor 200 can be dissipated to its surrounding environment (for example, by the flow of well fluid, to an annulus fluid between the casing 112 and the tubing 128, or to the Earth and/or surrounding cement).

Although FIG. 2A shows both the cable 210 and the cooling tube 220 cemented in the well 100, it is not necessary that both the cable 210 and the cooling tube 220 be cemented in the well 100. For example, the cable 210 can be cemented in the well 100, while the cooling tube 220 is not cemented in the well 100. Conversely, the cooling tube 220 can be cemented in the well 100, while the cable 210 is not cemented in the well 100.

Figure 2B:
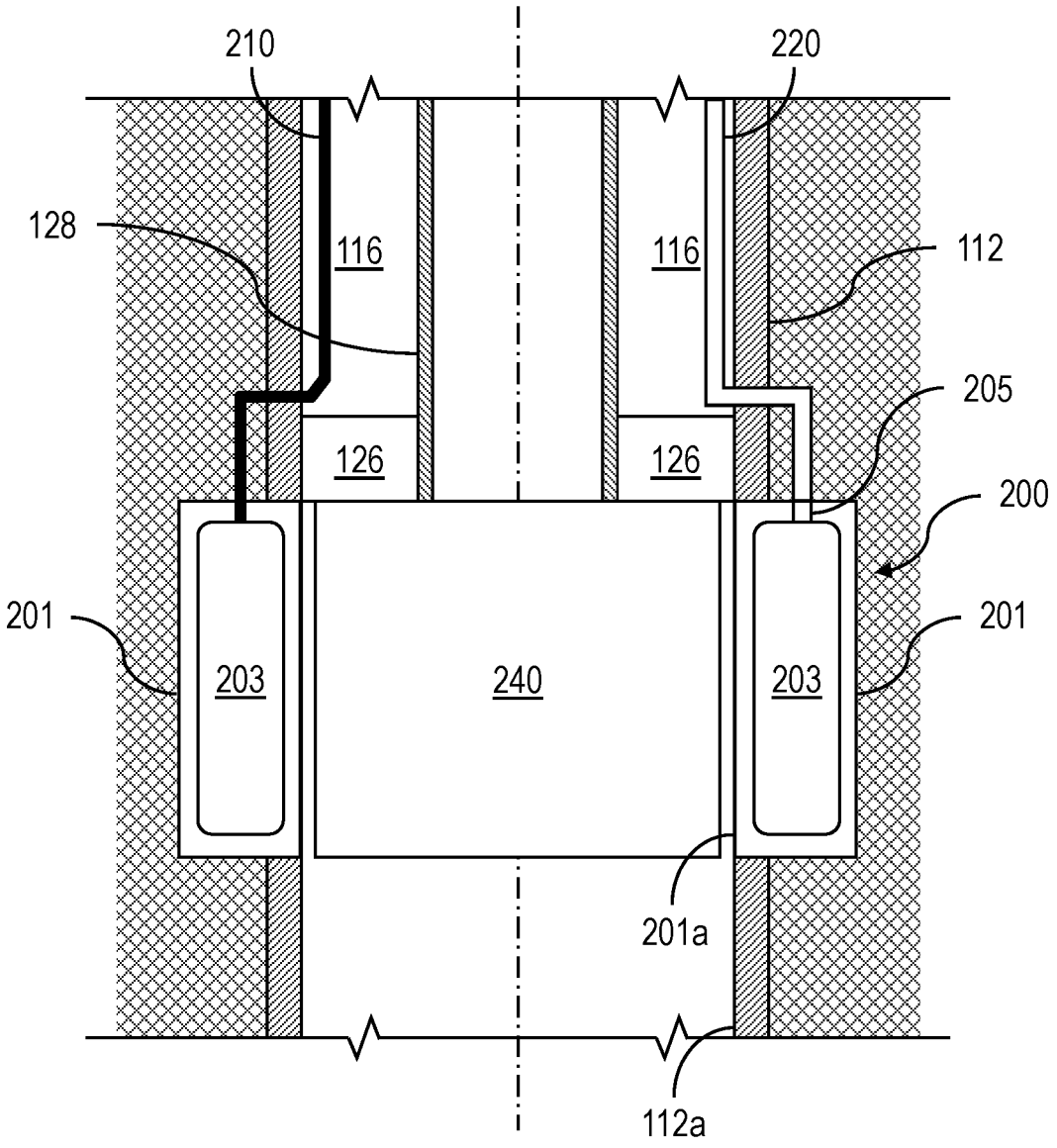

The downhole-type tool 200 shown in FIG. 2B is substantially similar the downhole-type tool 200 of FIG. 2A. The cable 210 and the cooling tube 220, however, run through the annulus 116 (in contrast to being cemented in the well 100). As shown in FIG. 2B, the seal system 126 can be located uphole of the electric rotor-impeller 240. Although FIG. 2B shows both the cable 210 and the cooling tube 220 running through the annulus 116, it is not necessary that both the cable 210 and the cooling tube 220 run through the annulus 116. For example, the cable 210 can run through the annulus 116, while the cooling tube 220 does not. Conversely, the cooling tube 220 can run through the annulus 116, while the cable 220 does not.

Although the housing 201 and the electric rotor-impeller 240 are shown in FIGS. 2A and 2B as having the same length along the central axis of the tubing 128, the housing 201 and the electric rotor-impeller 240 can have the same length or different lengths along the central axis of the tubing 128. For example, the housing 201 can have a shorter length in comparison to the electric rotor-impeller 240 along the central axis of the tubing 128. Alternatively, the housing 201 can have a longer length in comparison to the electric rotor-impeller 240 along the central axis of the tubing 128.

Figure 3:
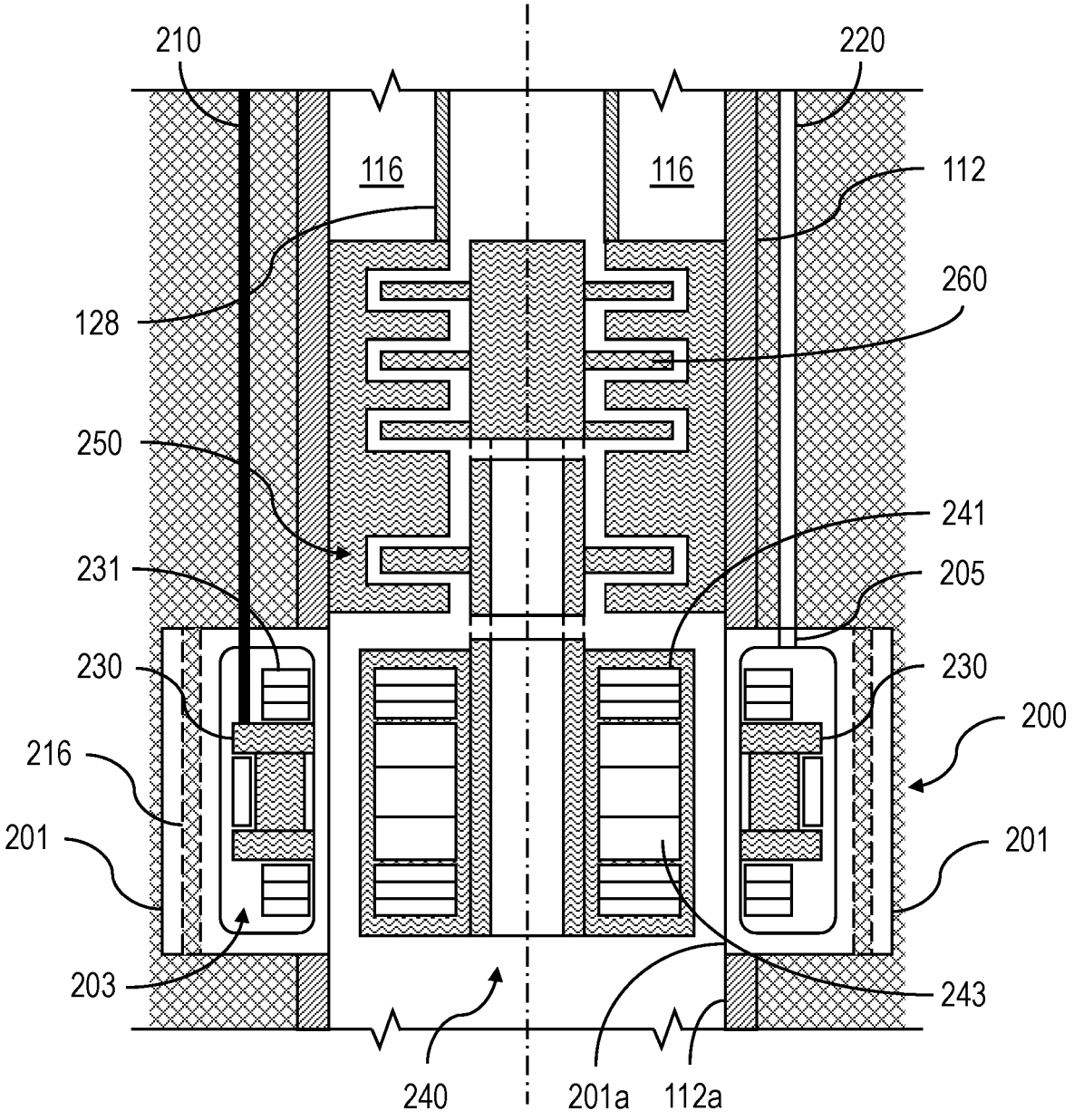

FIG. 3 illustrates an example downhole-type tool 200. The stator 203 encased within the housing 201 can include a magnetic field source 230, such as an electromagnetic coil. The electromagnetic coil 230 can be connected to the cable 210, and in response to receiving power, the electromagnetic coil 230 can generate a magnetic field to drive the electric rotor-impeller 240. The electric rotor-impeller 240 can include one or more permanent magnets 243. The electromagnetic coil 230 and the permanent magnet 243 can interact magnetically. The electromagnetic coil 230 and the permanent magnet 243 can each generate magnetic fields which attract or repel each other. The attraction or repulsion can impart forces that cause the rotor-impeller 240 to rotate.

The housing 201 can define one or more flow paths 216 for the flow of cement. Cement can flow through such flow paths 216 and secure the housing 201 in the well 100. Although shown in FIG. 3 as extending from the bottom wall to the top wall of the housing 201, the flow paths 216 can extend between any two walls of the housing 201. The flow paths 216 also need not be straight; they can extend through the housing 201 in any manner (for example, with a winding shape and/or branching).

The electric rotor-impeller 240 can include a rotating portion and a non-rotating portion. The rotating portion of the electric rotor-impeller 240 can include a central rotating shaft and one or more impellers 260 coupled to the central rotating shaft. The non-rotating portion of the electric rotor-impeller 240 can include a diffuser and can, for example, be attached to the production tubing 128. In some implementations, the rotor-impeller 240 is free of electrical components.

As shown in FIG. 3, one or more portions of the rotor-impeller 240 can be hollow, so that well fluid can flow through such portions of the rotor-impeller 240. For example, well fluid can flow past an outer, circumferential surface of the rotor-impeller 240, and the rotor-impeller 240 can define an inner bore through which well fluid can also flow.

The downhole-type tool 200 can include one or more radial bearings. The radial bearings can control the radial position of the central shaft of the rotor-impeller 240 with respect to the housing 201. The one or more radial bearings can be magnetic radial bearings or mechanical radial bearings. In the case of a magnetic radial bearing, the magnetic radial bearing can include a magnetic bearing actuator and a magnetic bearing target. The magnetic bearing actuator and the magnetic bearing target cooperate and interact magnetically to control levitation of the central shaft. The downhole-type tool 200 can include one or more magnetic bearing actuators 231 encased within the housing 201. The magnetic bearing actuators 231 can be permanent magnets (passive) or electromagnetic coils (active). In the case where the magnetic bearing actuators 231 are electromagnetic coils, they can be connected to the cable 210. The downhole-type tool 200 can include one or more magnetic bearing targets 241 in the electric rotor-impeller 240. The magnetic bearing targets 241 can be stationary metallic poles (solid or laminated), rotating metallic poles (solid or laminated), and/or permanent magnets. The magnetic bearing targets 241 can include stationary components, for example, for conducting magnetic fields in a specific path, and rotating components. As an example, the magnetic bearing targets 241 can include a solid metallic pole that conducts a magnetic field from a stator coil (such as the one or more magnetic bearing actuators 231). The magnetic field from the stator coil (231) is radial, and the solid metallic pole of the magnetic bearing target 241 can conduct the radial magnetic field to an axial magnetic field (for a magnetic thrust bearing), at which point the magnetic field crosses a gap between a stationary pole and a rotating pole, thereby imparting a force between the stationary pole and the rotating pole.

The downhole-type tool 200 can include one or more thrust bearings 250. The thrust bearings 250 can control the axial position of the central shaft of the rotor-impeller 240 with respect to the housing 201. The one or more thrust bearings 250 can be magnetic thrust bearings or mechanical thrust bearings. In the case of a magnetic thrust bearing 250, the magnetic thrust bearing 250 can include permanent magnets After installation of the downhole-type tool 200 in the well 100, the rotor-impeller 240 can optionally be retrieved from the well 100 while the stator 203 (and the housing 201) remain within the well 100. The housing 201 and the rotor-impeller 240 can be installed in the well 100 separately (physically and/or temporally). For example, the housing 201 (encasing the stator 203) can be installed in the well 100, and then the rotor-impeller 240 can be installed in the well 100. In some implementations, once the rotor-impeller 240 is positioned at a desired location within the well 100, the rotor-impeller 240 can be coupled to the housing 201 or a tubing of the well 100 (such as the production tubing 128) by a coupling part (not shown). Then, if desired, the rotor-impeller 240 can be decoupled from the housing 201 or the production tubing 128 and be retrieved from the well 100, while the stator 203 remains in the well 100.

Figure 4:
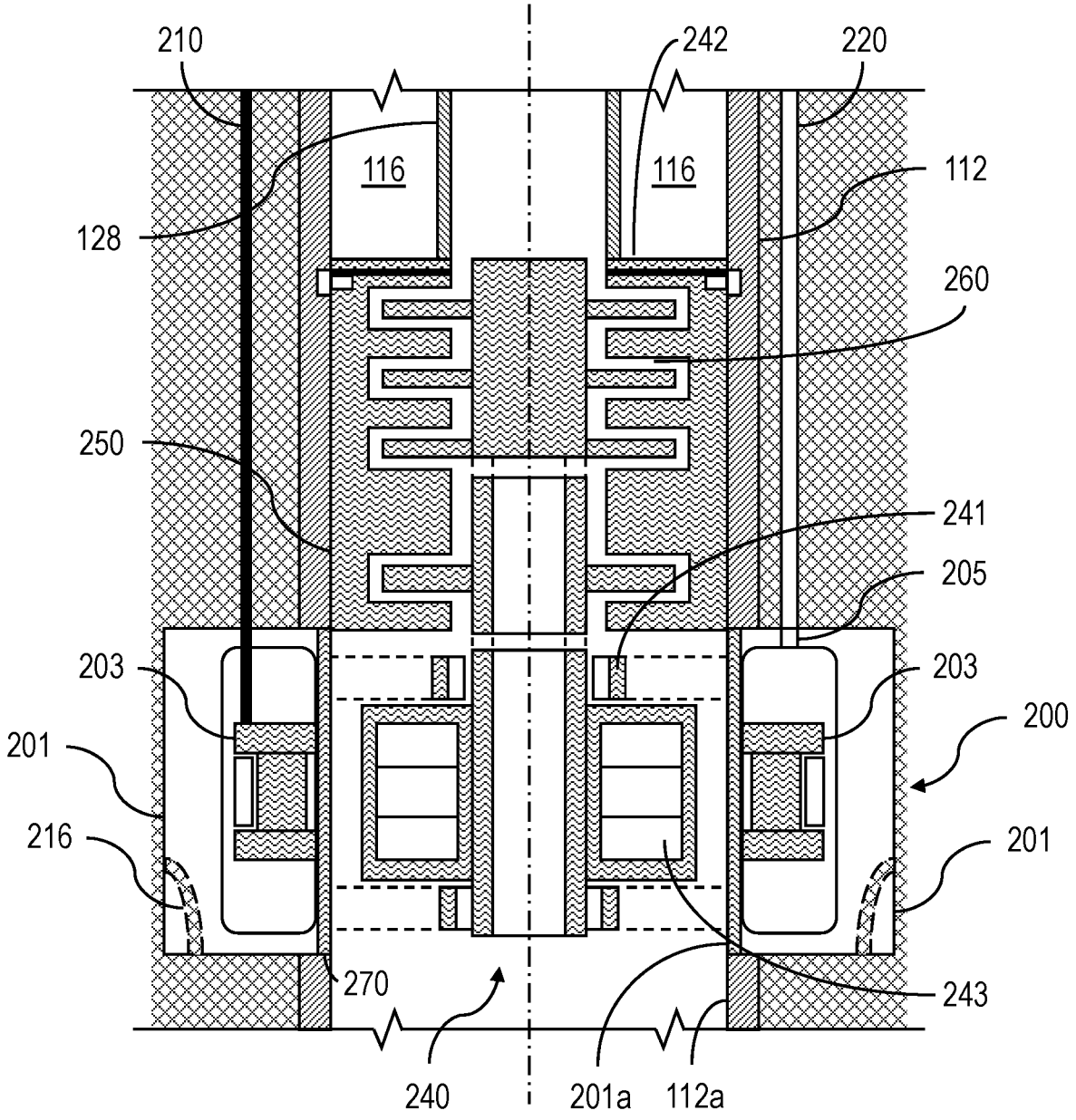

The downhole-type tool 200 shown in FIG. 4 is substantially similar to the downhole-type tool 200 of FIG. 3. As shown in FIG. 4, the flow paths 216 defined in the housing 201 can extend from other walls of the housing 201 (such as the bottom wall and the outer, circumferential wall of the housing 201). The radial bearings 241 of the downhole-type tool 200 shown in FIG. 4 can be mechanical bearings that allow for fluid to flow through the bearings 241. Although shown without magnetic bearing actuators 231 in FIG. 4, the downhole-type tool 200 can optionally include such magnetic bearing actuators 231 (as shown in FIG. 3). The downhole-type tool 200 can include a bearing stator tube 270. The bearing stator tube 270 can be made of a metallic or non-metallic material and can be used to isolate an inner portion of the stator 203 from production fluids. The inner circumferential surface of the bearing stator tube 270 is made of a material that is compatible with production fluid in order to minimize the risks and effects of corrosion and erosion and meet the operating life requirements of the well 100. The bearing stator tube 270 is of sufficient thickness and strength to maintain isolation from production fluids. Despite the thickness, any magnetic fields from the rotor-impeller 240, the stator 203, and the magnetic bearings (for example, the magnetic bearing actuator 231 and the magnetic bearing target 241) can pass through the bearing stator tube 270, thereby allowing the stator 203 to drive the rotor-impeller 240 (when acting as a motor), or the stator 203 to generate power as a result of the alternative field by the rotor-impeller 240 (when acting as a generator). The magnetic bearings can act as a mechanical support for the bearing stator tube 270 on the outer diameter of the bearing stator tube 270, thereby minimizing the mechanical and structural support requirements of the bearing stator tube 270. In other words, the magnetic bearings can help to reduce the mechanical load experienced by the bearing stator tube 270. In some implementations, the bearing stator tube 270 is reinforced with a high strength material, such as a carbon fiber wrap, to provide additional structural strength. In some implementations, reinforcing the bearing stator tube 270 with a high strength material can allow for the radial thickness of the bearing stator tube 270 to be thinner.

As shown in FIG. 4, the non-rotating portion of the electric rotor-impeller 240 can include a recirculation isolator 242 that is configured to create a seal between the non-rotating portion of the electric rotor-impeller 240 and the casing 112. In such implementations, the seal system 126 may not be necessary. The recirculation isolator 242 can couple to the production tubing 128 and prevent rotation of the non-rotating portion of the rotor-impeller 240 while the rotating portion of the rotor-impeller 240 rotates. In some implementations, the recirculation isolator 242 includes an anchor with mechanical slips that can stab into an inner wall of the well 100 (such as the inner wall 112*a* of the casing 112). The recirculation isolator 242 can also be used to position the rotor-impeller 240 within the well 100 and align the rotor-impeller 240 with the stator 203.

Figure 5:
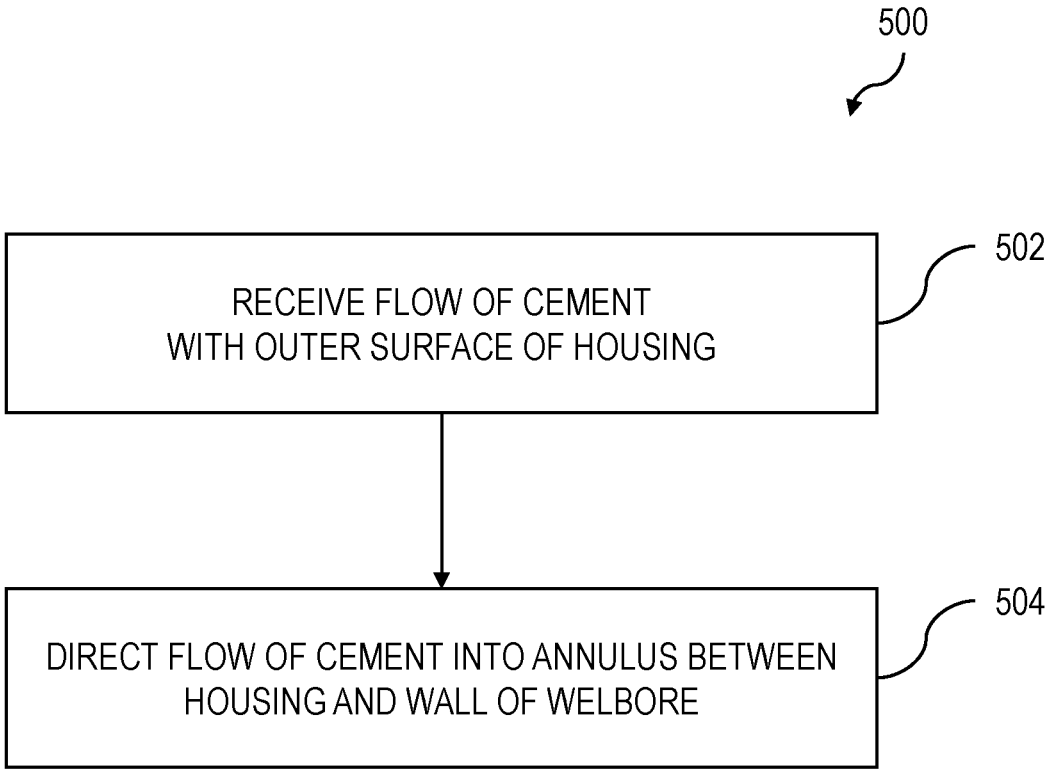
FIG. 5 is a flow chart of a method for using any one of the downhole-type tools of FIG. 2A, 2B, 3, or 4.

FIG. 5 is a flow chart of a method 500 for using the downhole-type tool 200. At step 502, a flow of cement is received with an outer surface of a housing (such as the housing 201). As described previously, the housing 201 encases an electric stator 203 and is sealed against ingress of cement to the electric stator 203. The flow of cement can be received with a top wall, a bottom wall, and an outer, circumferential wall of the housing 201. The flow of cement can be received through one or more flow paths (for example, flow path 216) defined in the housing 201. The one or more flow paths 216 can extend between the top wall and the bottom wall of the housing 201. The one or more flow paths 216 can extend between the outer, circumferential wall and the bottom wall of the housing 201.

At step 504, the flow of cement is directed into an annulus between the housing 201 and a wall of the wellbore (such as the wellbore wall 130). The housing 201 is cemented in the well 100. As described previously, the housing 201 defines an inner bore and has an inner, circumferential wall 201*a* that is continuous with an inner wall 112*a* of a casing joint (such as a casing joint of the casing 112) that is affixed to the housing 201. A flow of well fluid can be received at this inner, circumferential wall of the housing 201.

The electric stator 203 can be connected to and receive power from a power source that is in a remote location (for example, at the surface 106). In response to receiving power, the electric stator 203 can drive an electric rotor-impeller (for example, the electric rotor-impeller 240) that is positioned within the inner bore of the housing 201. Rotation of the electric rotor-impeller 240 can induce well fluid flow by creating a pressure differential within the well 100 (as described previously).

Figure 6:
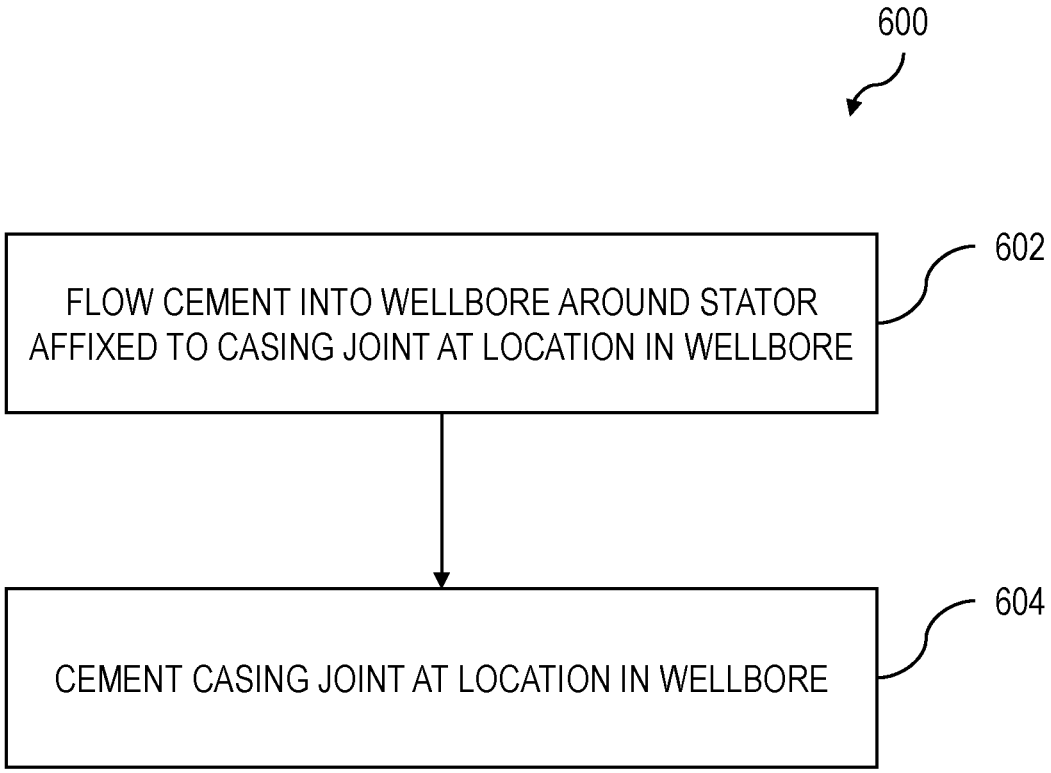
FIG. 6 is a flow chart of a method for installing any one of the downhole-type tools of FIG. 2A, 2B, 3, or 4.

FIG. 6 is a flow chart of a method 600 for installing the downhole-type tool 200. At step 602, cement is flowed into a wellbore (such as the wellbore of well 100) around an electric stator (such as the electric stator 203 of the downhole-type tool 200) affixed to a casing joint (such as a casing joint of the casing 112) at a location in the wellbore. The electric stator 203 is encased within a housing (such as the housing 201) that is sealed against ingress of cement to the electric stator 203. As described previously, the housing 201 defines an inner bore and has an inner bore wall 201*a* that is continuous with an inner wall 112*a* of the casing joint. The electric stator 203 is configured to drive an electric rotor-impeller (such as the electric rotor-impeller 240). Cement can be flowed into an annulus between the housing 201 and a wall of the wellbore (such as the wellbore wall 130). Cement can be flowed through one or more flow paths defined in the housing 201 (such as the flow path 216).

Before cement is flowed into the wellbore at step 602, the wellbore can be enlarged at the location within which the electric stator 203 will reside in the wellbore. For example, the well 100 can be underreamed. After enlarging the wellbore and before flowing cement into the wellbore at step 602, the electric stator 203 can be positioned within the location at which the wellbore was enlarged. The portion of the wellbore that is enlarged can have a length that is slightly longer than the length of the housing 201, so that there can be some room above and below the housing 201 for cement to flow through. One or more centralizers can be employed to ensure that the housing is centered within the wellbore, so that cement can be uniformly distributed around the housing 201 within the wellbore.

At step 604, the casing joint is cemented at the location of the wellbore. In some implementations, a cable (such as the cable 210) connecting the electric stator 203 to a power source at a remote location (for example, at the surface 106) is cemented in the wellbore, outside the casing joint. For example, the cable 210 can be cemented in the annulus between the casing 112 and the wellbore wall 130 (an example of this configuration is shown in FIG. 2A). In some implementations, the cable 210 runs through the casing 112 and is connected to the power source through the annulus 116 between the casing 112 and the production tubing 128 (an example of this configuration is shown in FIG. 2B).

Similarly, in some implementations, a cooling tube (such as the cooling tube 220) connecting an inner volume of the housing 201 to a source of coolant at a remote location (for example, at the surface 106) is cemented in the wellbore, outside the casing joint. For example, the cooling tube 220 can be cemented in the annulus between the casing 112 and the wellbore wall 130 (an example of this configuration is shown in FIG. 2A). In some implementations, the cooling tube 220 runs through the casing 112 and is connected to the coolant source through the annulus 116 between the casing 112 and the production tubing 128 (an example of this configuration is shown in FIG. 2B).

After cementing the casing joint at step 604, the electric rotor-impeller 240 can be positioned within the inner bore of the housing 201. Power can then be provided to the electric stator 203 through the cable 210 in order to drive rotation of the electric rotor-impeller 240. In some cases, it may be desirable to retrieve the electric rotor-impeller 240 (for example, to perform maintenance). The electric rotor-impeller 240 can be retrieved from the wellbore while the stator

203 remains within the wellbore. For example, the electric rotor-impeller 240 can be retrieved from the well 100 using a slickline.

Figure 7A:
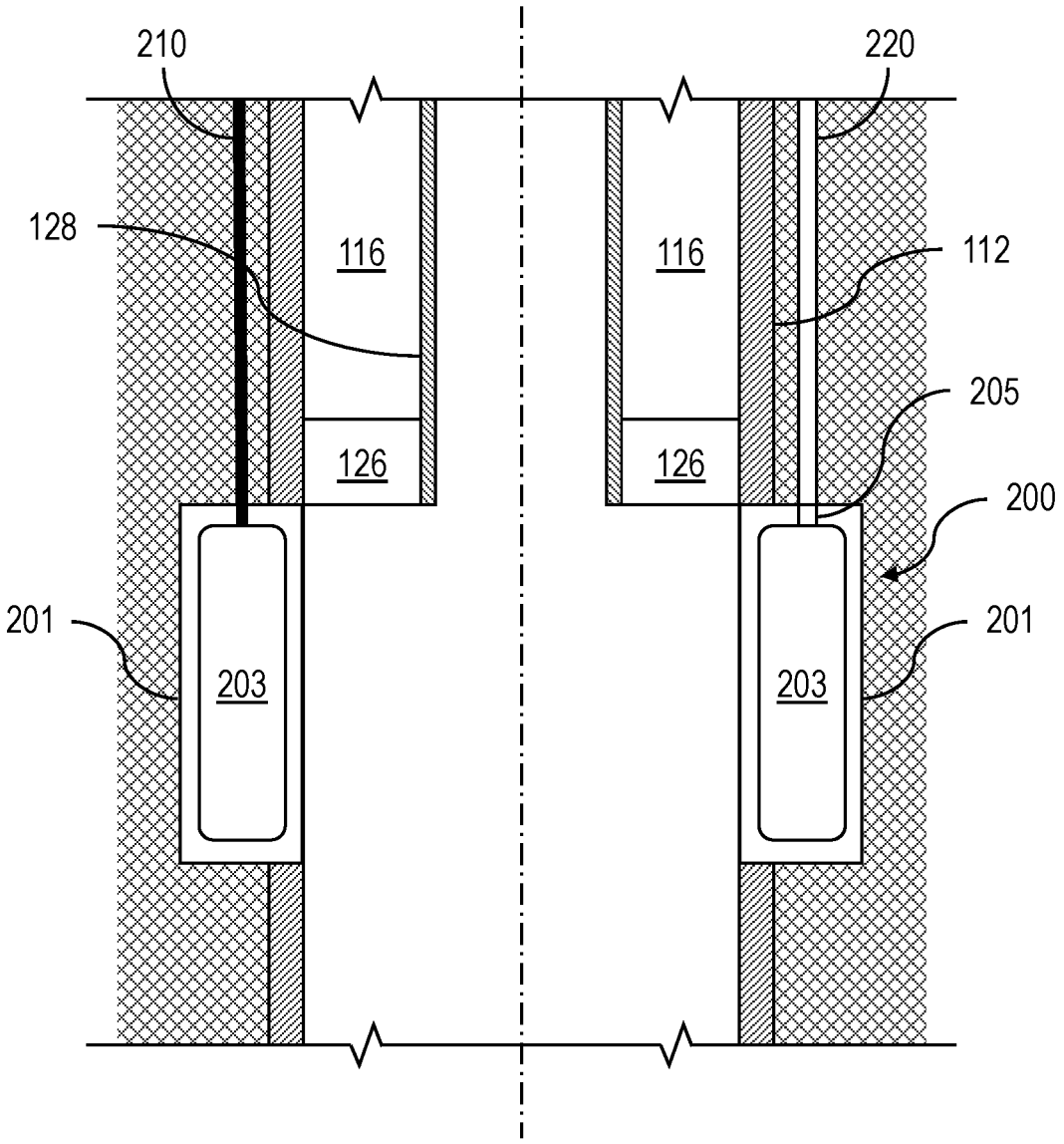
FIGS. 7A, 7B, 7C, 7D, and 7E are schematic diagrams of example downhole-type tools.

FIG. 7A illustrates an example of the downhole-type tool 200, in which the rotor-impeller 240 has been retrieved from the well 100, while the stator 203 remains within the well 100. After maintenance is complete on the electric rotor-impeller 240, it can be re-installed in the well 100. Alternatively, another compatible electric rotor-impeller can be installed in the well 100 place of the retrieved electric rotor-impeller 240.

Figure 7B:
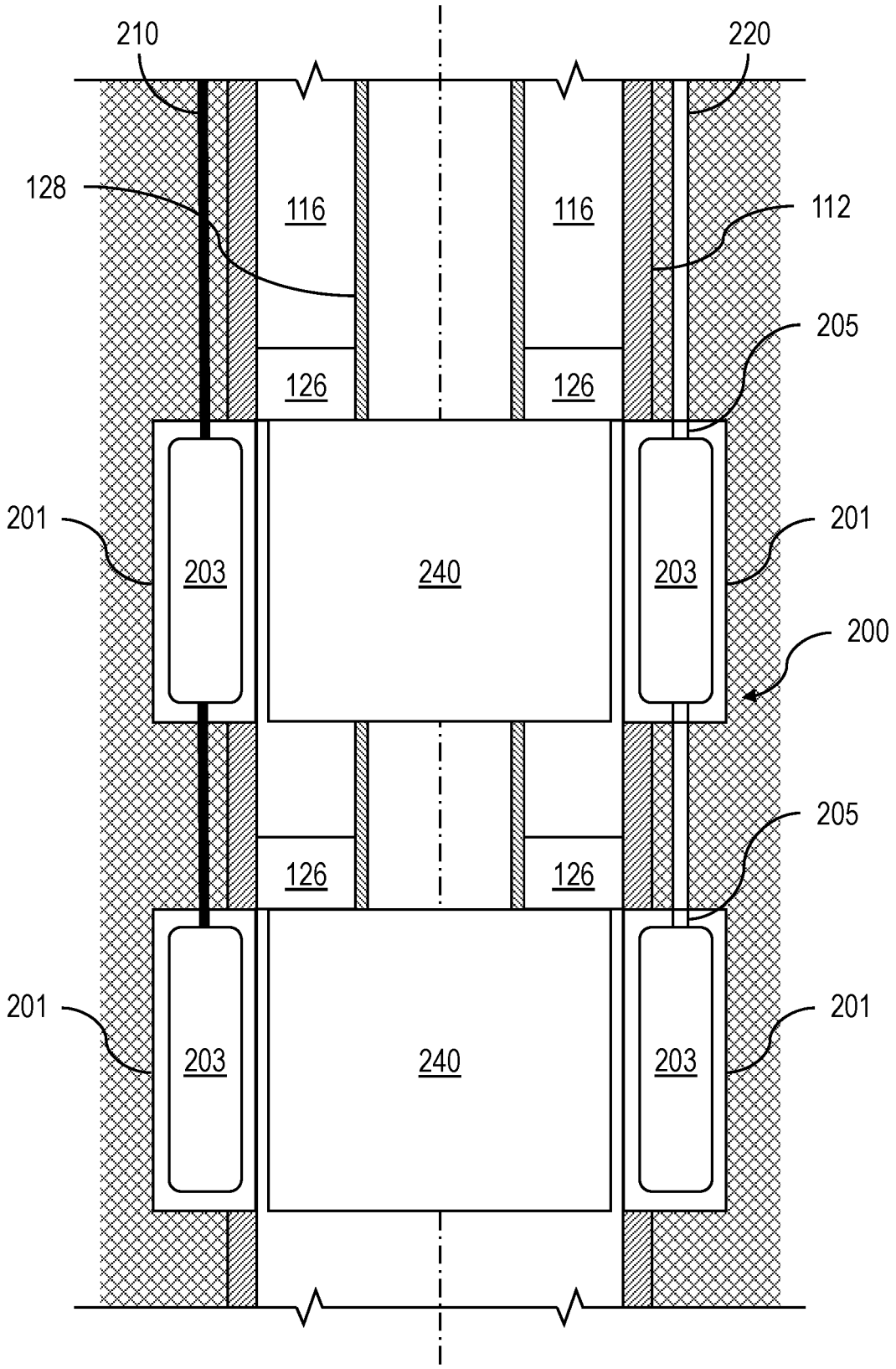
Figure 7C:
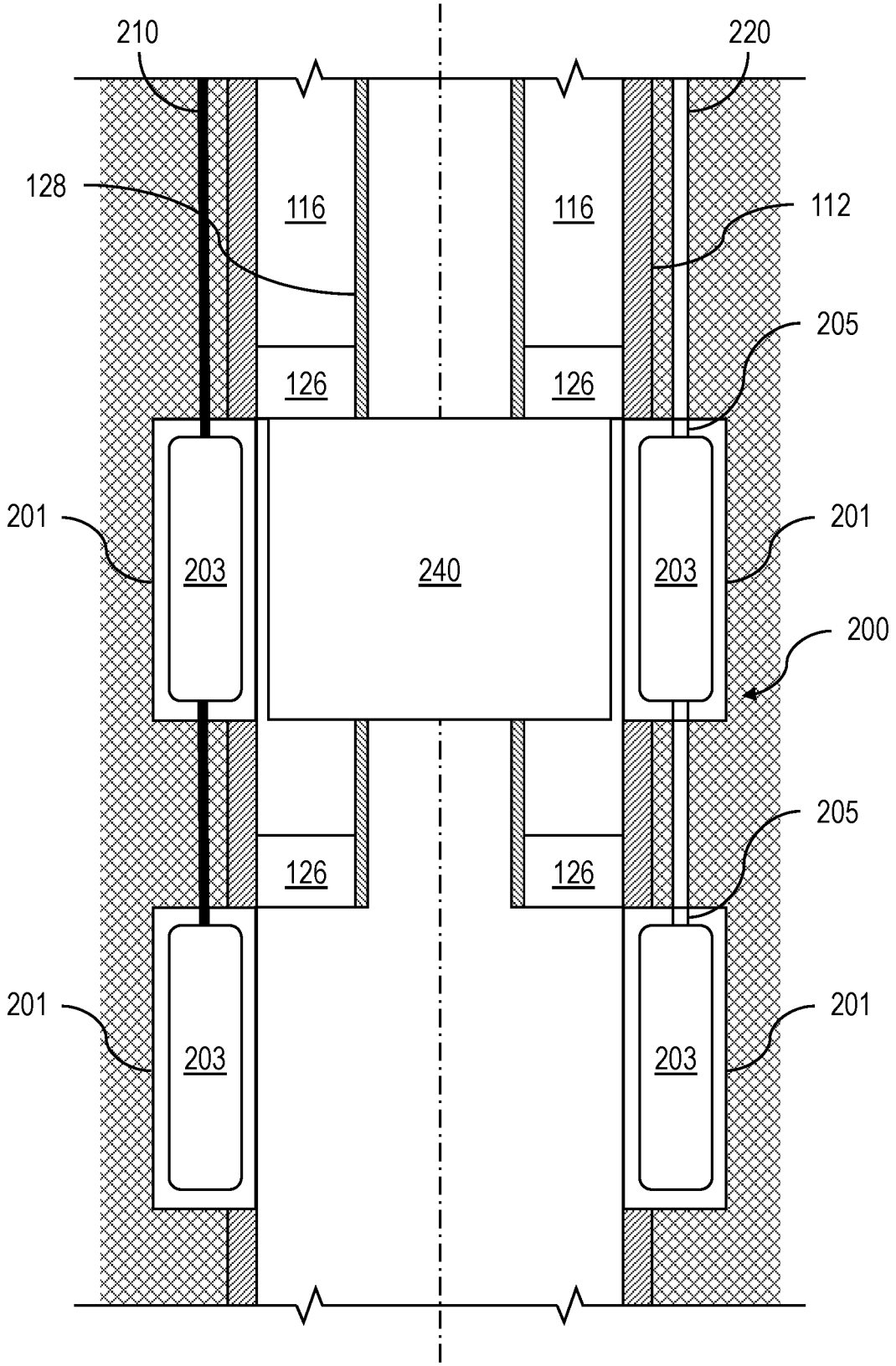

The features described can optionally be duplicated and can act together or independently to provide higher output or redundancy to enhance long term operation. For example, the downhole-type tool 200 can include multiple stators 203 and rotor-impellers 240. Such duplicate components can be installed concurrently or at different times. An example of the downhole-type tool 200 including multiple stators 203 and rotor-impellers 240 is shown in FIG. 7B. FIG. 7C illustrates the downhole-type tool 200 of FIG. 7B, but one of the rotor-impellers 240 (the previously downhole one of the two) has been retrieved from the well 100, while the stators 203 and the other rotor-impeller 240 remains within the well 100.

Figure 7D:
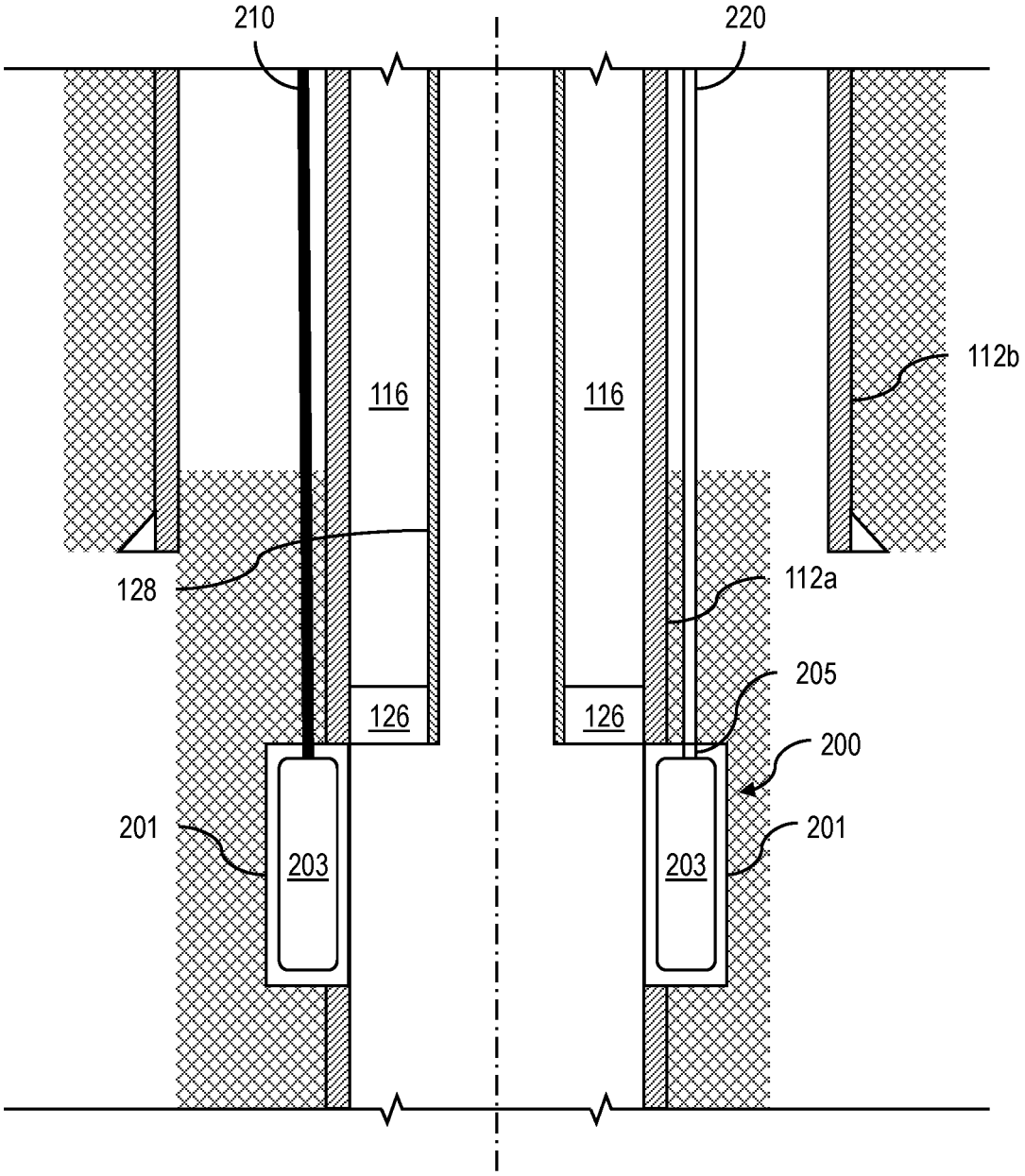
Figure 7E:
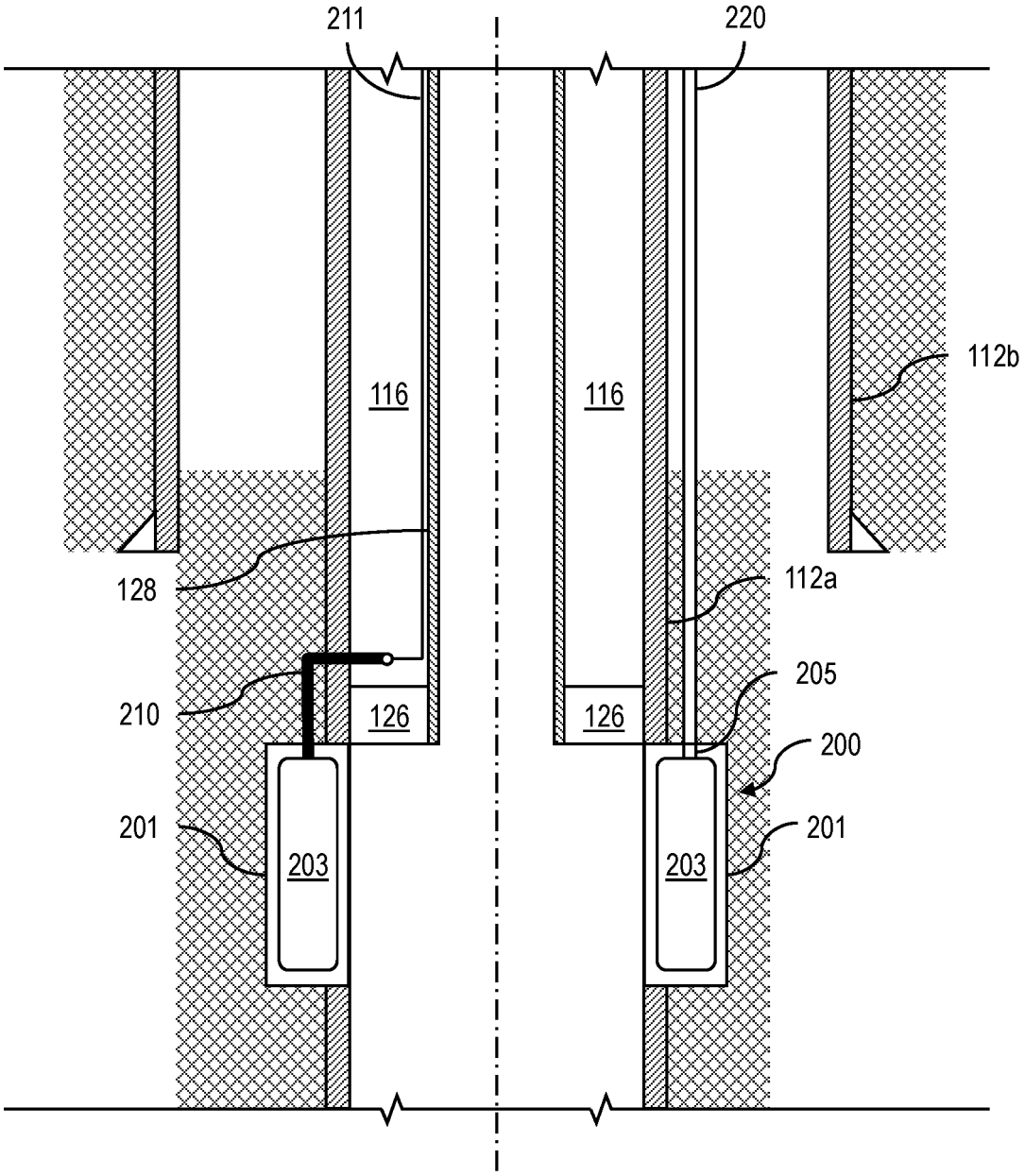

As an example (although the implementations shown in FIGS. 1, 2A, 2B, 3, 4, 7A, 7B, and 7C are in relation to a single casing 112), the downhole-type tool 200 can be implemented in wells that include multiple casings that are cemented in the well. For example, as shown in FIG. 7D, the well 100 can include a first casing 112*a* within a second casing 112*b*; the stator 203 can be affixed to the first casing 112*a*; and the first casing 112*a*, the second casing 112*b*, and the stator 203 can be cemented within the well 100. Any cables or tubes (such as the cable 210, the cooling tube 220, or both) can be run through the annulus between the first casing 112*a* and the second casing 112*b*. In some implementations, as shown in FIG. 7E, the cable 210 includes (and terminates at) a downhole connector. In such implementations, a retrievable cable 211 can be run from the surface 106 into the well 100 (for example, via the production tubing 128) to connect to the downhole connector and provide power.

In this disclosure, "approximately" means a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

What is claimed is:

1. A method, comprising:

receiving a flow of cement through a flow path defined in a housing;

directing the flow of cement into an annulus between the housing and a wall of a wellbore, the housing encasing an electric stator and sealed against ingress of the cement to the electric stator, the housing defining an inner bore and having an inner, circumferential wall, wherein receiving the flow of cement through the flow path and directing the flow of cement into the annulus between the housing and the wall of the wellbore results in cementing the housing within the wellbore;

circulating a coolant through the housing to provide cooling to the electric stator, wherein the coolant floods an inner volume of the housing within which the electric stator resides; and receiving a flow of well fluid at the inner, circumferential wall of the housing after the housing has been cemented within the wellbore.

2. The method of claim 1, wherein the flow path extends between a top wall and a bottom wall of the housing.

3. The method of claim 1, wherein the flow path extends between an outer, circumferential wall and a bottom wall of the housing.

4. The method of claim 1, wherein the inner, circumferential wall of the housing is continuous with an inner wall of a casing joint affixed to the housing.

5. The method of claim 1, comprising receiving, with the electric stator, power from a remote location.

6. The method of claim 5, comprising driving, with the electric stator, an electric rotor-impeller positioned within the interior of the housing in response to receiving power.

7. The method of claim 1, wherein the method is performed with a downhole-type tool comprising:

the housing configured to be affixed to a casing joint, the inner, circumferential wall of the housing continuous with an inner wall of the casing joint; and the electric stator configured to drive an electric rotor-impeller.

8. The method of claim 7, wherein the downhole-type tool comprises the electric rotor-impeller, wherein the electric rotor-impeller is retrieved from a wellbore while the electric stator remains within the wellbore.

9. The method of claim 8, wherein the housing comprises a cooling port, and the method comprises connecting the cooling port to a cooling tube providing the coolant from a remote location to the housing.

10. The method of claim 8, wherein the downhole-type tool comprises a cable connected to the stator, and the cable provides power from a remote location to the stator to drive the electric rotor-impeller.

11. The method of claim 10, wherein the cable is cemented in the wellbore outside of the casing joint.

* * * * *